US006756960B2

(12) United States Patent
Miyatake

(10) Patent No.: US 6,756,960 B2
(45) Date of Patent: Jun. 29, 2004

(54) DISPLAY DEVICE WITH A SWITCHING CIRCUIT TURNED ON/OFF BY A SHIFT REGISTER OUTPUT

(75) Inventor: Masaki Miyatake, Fukiage-Machi (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 225 days.

(21) Appl. No.: 10/021,348

(22) Filed: Dec. 19, 2001

(65) Prior Publication Data

US 2002/0075222 A1 Jun. 20, 2002

(30) Foreign Application Priority Data

Dec. 19, 2000 (JP) ..... 2000-385299
Nov. 28, 2001 (JP) ..... 2001-362666

(51) Int. Cl.[7] ..... G09G 3/36

(52) U.S. Cl. ..... 345/98; 345/99; 345/100; 345/691

(58) Field of Search ..... 345/87–103, 204–209

(56) References Cited

U.S. PATENT DOCUMENTS 6,020,871 A * 2/2000 Asada ..... 345/98
6,175,346 B1 * 1/2001 Chiu et al. ..... 345/82
6,377,235 B1 * 4/2002 Murade et al. ..... 345/100
6,501,456 B1 * 12/2002 Saito et al. ..... 345/98
6,531,996 B1 * 3/2003 Murade ..... 345/98

FOREIGN PATENT DOCUMENTS

JP 11-338440 12/1999

* cited by examiner

*Primary Examiner*—Amr Awad
(74) *Attorney, Agent, or Firm*—Oblon, Spivak, McClelland, Maier & Neustadt, P.C.

(57) ABSTRACT

An object of the present invention is to provide a display device in which a display quality is excellent and a timing margin is large. A signal line driving circuit in a display device has a shift register. Each of the register circuit in the shift register 1 has latch circuits of two stages connected in cascade, an inverter connected to an output terminal of the latch circuit, and clocked inverters connected to an output terminal connected to the inverter. Because the present invention minimizes the number of gate stages from when a start signal is inputted to the shift register, until when the control signal is inputted to analog switches for supplying an analog pixel voltage to the signal lines. Therefore, there is not a likelihood to be influenced by a dispersion of properties of TFTs in the circuits, thereby enlarging an operational margin. Furthermore, because a pulse cut circuit staggers a timing in which the analog switches turn from OFF to ON, there is not a likelihood that the adjacent analog switches turn ON at the same time.

9 Claims, 10 Drawing Sheets

DISPLAY DEVICE WITH A SWITCHING CIRCUIT TURNED ON/OFF BY A SHIFT REGISTER OUTPUT

CROSS REFERENCE TO RELATED APPLICATIONS

This application is based upon and claims the benefit of priority from the prior Japanese Patent Applications No. 2000-385299, filed on Dec. 19, 2000, and No. 2001-362666, filed on Nov. 28, 2001, the entire contents of which are incorporated herein by reference.

BACKGROUND OF THE INVENTION

1. Field of the Invention

The present invention relates to a display device for driving signal lines by turning ON/OFF a switching circuit based on shift pulses outputted from a shift resister.

2. Related Background Art

A thin and lightweight display device is widely used in portable electrical equipments such as a mobile phone, a note-type computer and a portable television. Especially, it is possible to accomplish a thinner and lighter liquid crystal display with a low power consumption. Therefore, liquid crystal displays have been widely developed, and it is possible to buy a liquid crystal display with high resolution and large screen size at a relatively low price.

Among liquid crystal displays, a liquid crystal display of an active matrix type, in which TFTs(Thin Film Transistors) are provided in the vicinity of intersections of signal lines and scanning lines excels in color quality. Furthermore, there is less residual image in such a liquid crystal display. Because of this, the liquid crystal display of the active matrix type is expected to become far popular in near feature.

A conventional liquid crystal display of the active matrix type has a driving circuit for driving signal lines and scanning lines formed on a substrate, which is different from a pixel array substrate, on which the signal lines and the scanning lines are arranged. Because of this, it has been difficult to downscale the entire liquid crystal display. Therefore, manufacturing processes for integrally forming the driving circuit on the pixel array substrate are now being intensely developed.

Because liquid crystal displays are used for various applications, there is an increased demand to switch driving directions of the signal lines either from left to right or from right to left of the screen. When such a switching operation becomes possible, even if a direction to train a digital camera does not coincide with a direction to see the monitor of the camera, it is possible to operate the camera without an uncomfortable feeling, thereby improving operationality and enhancing a commercial value of the camera.

If the above-mentioned switching becomes possible in the liquid crystal display for a personal computer, it is possible to compensate for display irregularity occurring in a certain scanning direction by switching the scanning direction, thereby improving the display quality.

In order to switch the driving direction of the signal lines, a shift register capable of bidirectionally shifting has to be provided in the signal line driving circuit.

FIG. 8 is a circuit diagram showing a configuration of a conventional bidirectional shift register 40. The shift register 40 of FIG. 8 has a plurality of register circuits 2 connected in cascade. Each of the registers 2 is composed of a latch circuit 44 having clocked inverters 41 and 42 and an inverter 43, and clocked inverters 45 and 46 for switching the shift direction of the shift register 40. A NAND gate 47 is provided for each of the register circuits 2.

The NAND gate 47 executes a NAND operation between a shift pulse outputted from the corresponding register circuit 2 and the shift pulse outputted from the register circuit 2 of the preceding stage. Outputs of the NAND gates 47 are used to control ON/OFF of analog switches not shown in FIG. 8. When the analog switch turns ON, an analog pixel voltage on a video bus is provided to the corresponding signal line.

FIG. 9 is an operational timing chart of input/output signals of the shift register 40 of FIG. 8. As shown in FIG. 9, the shift direction of the shift register 40 is switched by a logic of a shift direction control signal. FIG. 9 shows an example of performing a forward shift when the shift direction control signal LR1 is in low level and the another shift direction control signal LR2 is in high level, and performing an inverse direction shift when the signal LR1 is in high level and the signal LR2 is in low level.

Because the shift register 40 of FIG. 8 is a so-called shift register of a half clock type, which shifts the shift pulses by every half cycle of clock signals, circuit configurations of odd stages and even stages are different from each other. Therefore, the timing of the output signal of each of the register circuits 2 constituting the shift register 40 has to be adjusted by using the NAND gate 47. As a result, the number of gates existing after the start signal is inputted to the shift register 40 and before a shift pulse obtained by shifting the start signal is inputted to an analog switch via the circuit of FIG. 8 increases, thereby increasing delay of the shift pulses relative to the clock signal.

Therefore, there is a likelihood that the display is influenced by a fluctuation of properties of the TFTs in the signal driving circuit, thereby deteriorating image quality. More specifically, a plurality of analog switches arranged adjacent to each other turn ON at the same time, the load of the video bus fluctuates, and the potential on the video bus causes an overshoot or undershoot. When the potential on the video bus fluctuates, before the potential returns to the original potential, the analog switch, which should essentially be turned ON, turns OFF. Therefore, an erroneous potential is held at the signal line connected to the analog switch, thereby causing a block irregularity.

In order to avoid such a problem, a pulse cut circuit is often provided at a subsequent stage of the NAND gate 47 of FIG. 8. FIG. 10 is a circuit diagram showing an internal configuration of a conventional pulse cut circuit 50, and FIG. 11 is an operational timing chart of the circuit of FIG. 10.

The pulse cut circuit 50 of FIG. 10 has inverters 51–53 and a NAND gate 54 having three input terminals. Each NAND gate 54 executes a logical operation based on the shift pulse of the present stage and inverse signals of the shift pulses of the preceding and next stages.

The NAND gate 54 of FIG. 10 changes a rising edge position and a trailing edge position of the shift pulse in the present stage and outputs a pulse having a narrower pulse width than the shift pulse of the present stage.

With the pulse cut circuit 50 of FIG. 10, regardless of the shift direction of the shift register 40, it is possible to constantly narrow the pulse width of the shift pulse of the present stage by a certain amount.

However, when a timing at which the analog switch turns from ON to OFF is controlled by the pulse cut circuit 50 of FIG. 10, a timing at which the analog switch turns from ON to OFF fluctuates due to the pulse width of the shift pulses of the preceding and the subsequent stages and the properties of the TFTs. Therefore, there is a likelihood that a plurality of analog switches turn ON at the same time.

Thus, if a timing at which the analog switch turns from ON to OFF staggers, display irregularities appear more clearly, as compared with the case in which the timing changing from ON to OFF staggers, thereby also decreasing a timing margin.

SUMMARY OF THE INVENTION

An object of the present invention is to provide a display device in which display quality is excellent and a timing margin is large.

In order to achieve the foregoing object, a display device according to the present invention, comprising:

signal lines and scanning lines in a matrix form;

display elements arranged in the vicinity of intersections of the signal lines and the scanning lines;

a signal line driving circuit configured to drive each of the signal lines; and a scanning line driving circuit configured to drive each of the scanning lines;

wherein said signal line driving circuit includes:

a shift resister, having a plurality of resister circuits connected in cascade, capable of allowing a clock signal to shift in two-way directions between these resister circuits, configured to output from each of the resister circuits, shift pulses obtained by allowing the clock signal to shift;

a pulse width adjusting circuit configured to adjust pulse widths of said shift pulses; and a switching circuit configured to turn ON/OFF based on the output of said pulse width adjusting circuit, and to provide a pixel voltage to the corresponding signal line to the ON period, wherein said plurality of resister circuits are composed of the same circuit configuration, respectively; and said pulse width adjusting circuit adjusts the pulse width of said shift pulse so that more than one of said switching circuits do not turn on at the same time.

Furthermore, a display device according to the present invention, comprising:

signal lines and scanning lines in a matrix form;

display elements arranged in the vicinity of intersections of the signal lines and the scanning lines;

a signal line driving circuit configured to drive each of the signal lines; and a scanning line driving circuit configured to drive each of the scanning lines;

wherein said scanning line driving circuit includes:

a shift resister, having a plurality of resister circuits connected in cascade, capable of allowing a clock signal to shift in two-way directions between these resister circuits, configured to output from each of the resister circuits, shift pulses obtained by allowing the clock signal to shift; and a pulse width adjusting circuit configured to adjust pulse widths of said shift pulse, wherein said plurality of resister circuits are composed of the same circuit configuration, respectively; and said pulse width adjusting circuit adjusts the pulse width of said shift pulse so that more than one of said switching circuits do not turn on at the same time.

DESCRIPTION OF THE PREFERRED EMBODIMENTS

Hereinafter, a display device according to the present invention will be more specifically explained with reference to the drawings. Hereinafter, a signal line driving circuit used for a liquid crystal display of an active matrix type will be explained.

Figure 1:
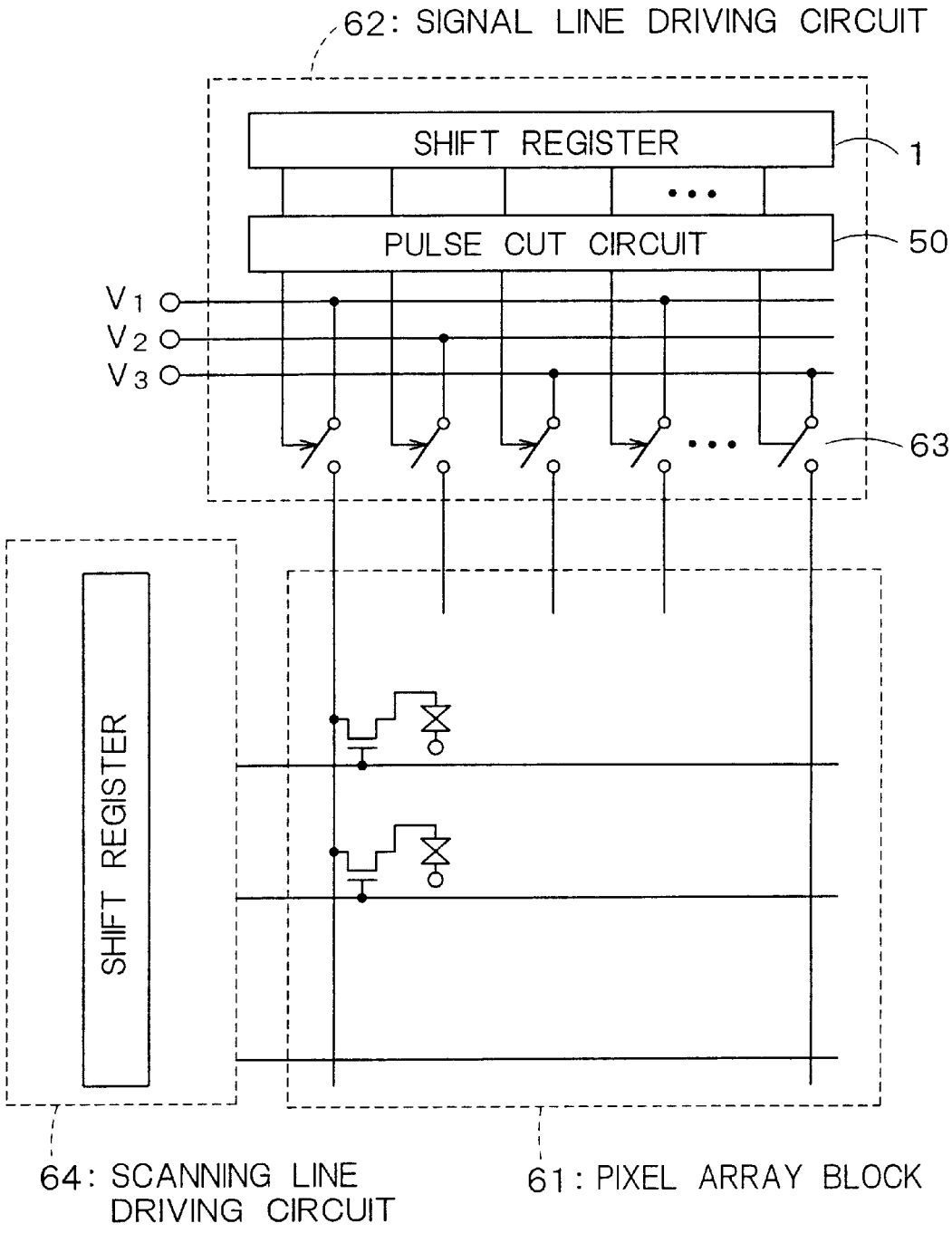
FIG. 1 is a block diagram showing a schematic configuration of one embodiment of a liquid crystal display.

FIG. 1 is a block diagram showing a schematic configuration of one embodiment of a liquid crystal display. The liquid crystal display of FIG. 1 has a pixel array block 61 in which pixel TFTs are formed in vicinity of signal lines and scanning lines arranged in a matrix form, a signal line driving circuit 62 for driving each of the signal lines, and a scanning line driving circuit 64 for driving each of the scanning lines.

The signal line driving circuit 62 has a shift register 1 for outputting the shift pulses shifting a start pulse supplied from outside in sync with a clock signal, a pulse cut circuit 50 for adjusting pulse widths of the shift pulses, and an analog switch 63 for switching whether or not to provide a pixel voltage on a video bus to the corresponding signal line.

The scanning line driving circuit 64 has a shift register for generating scanning pulses provided to each of the scanning lines.

The signal line driving circuit 62 of the present embodiment has a shift register for outputting the shift pulses shifting the start pulse in order, and analog switches (switching circuit) 63 for controlling ON/OFF based on the shift pulses. When the analog switches 63 turn ON, the pixel voltages on the video buses are provided to the corresponding signal line to perform a liquid display.

Figure 2:
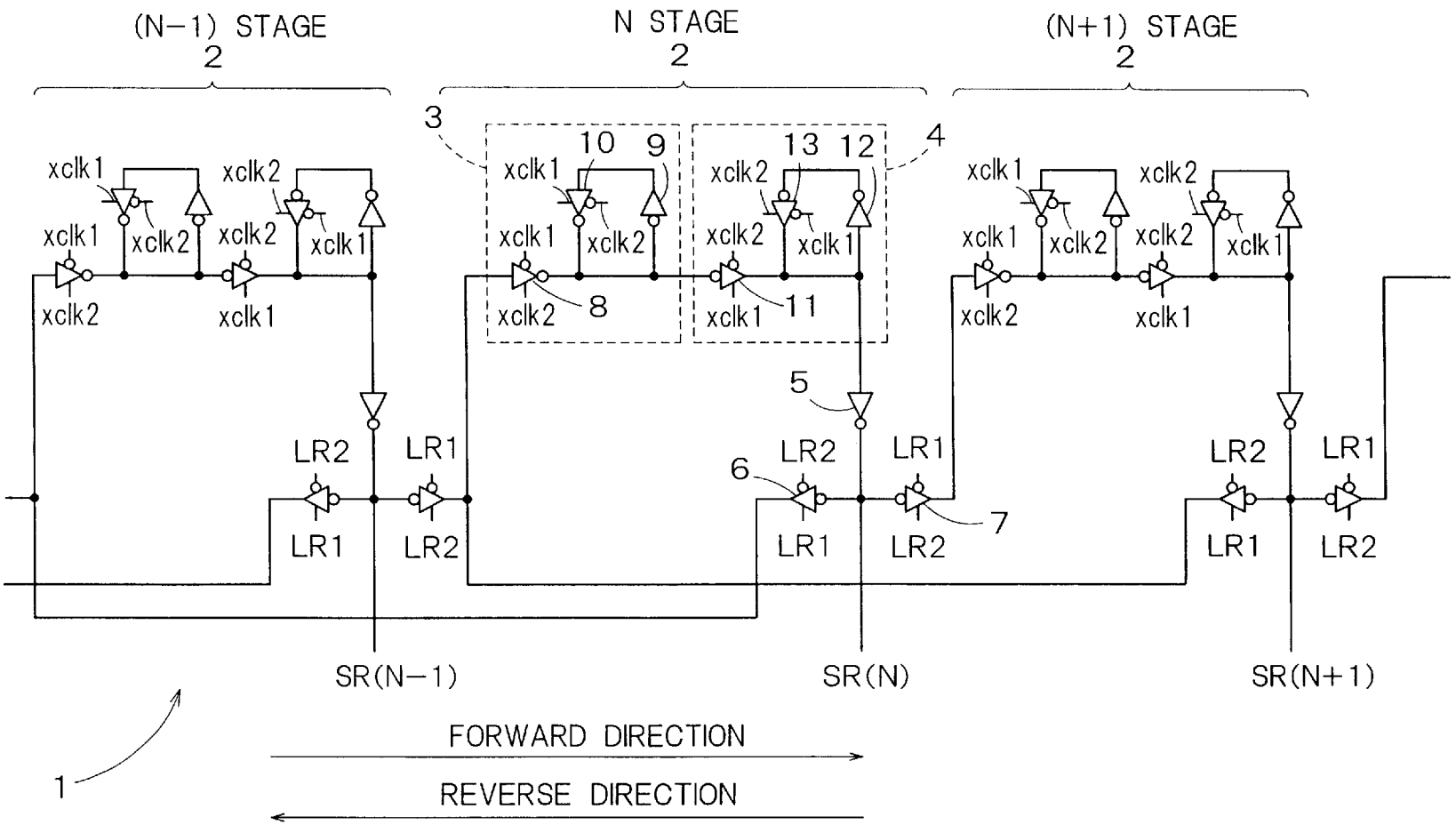
FIG. 2 is a circuit diagram of a first embodiment of the shift register.

FIG. 2 is a circuit diagram of a first embodiment of the shift register 1. The shift register 1 of FIG. 2 has a plurality of register circuits 2 connected in cascade. Each of the register circuits 2 outputs the shift pulse shifting the start pulse in order in sync with the clock signal.

Each of the register circuits 2 in the shift register 1 has latch circuits (first and second latch circuits) 3 and 4 connected in cascade, an inverter 5 connected to an output terminal of the latch circuit 4 of the subsequent stage, and clocked inverters (second and first clocked inverters) 6 and 7 connected to an output terminal of the inverter 5. All the register circuits 2 in the shift register 1 have a common circuit configuration.

Each of the latch circuits 3 has a clocked inverter (third clocked inverter) 8 for latching an output of the clocked inverter 7 in the register circuit 2 of the preceding stage, an inverter 9 for inverting and outputting an output of the clocked inverter 8, and clocked inverter (fourth clocked inverter) 10 for latching an output of the inverter 9. The output terminal of the clocked inverter 10 is connected to the output terminal of the clocked inverter 8 and an input terminal of the inverter 9.

Similarly, each of the latch circuits 4 has a clocked inverter 11 for latching an output of the latch circuit 3, an inverter 12 for inverting the output of the clocked inverter 11, and a clocked inverter 13 for latching an output of the inverter 12. An output terminal of the clocked inverter 13 is connected to the output of the clocked inverter 11 and an input terminal of the inverter 12.

A clock signal XCLK1 and its inverted signal XCLK2 are inputted to a control terminal of each of the clocked inverters in FIG. 2. Each of these signals XCLK1 and XCLK2 has a logic contrary to each other.

The latch circuit 3 performs a latch operation at a rising edge of the clock signal XCLK1. The latch circuit 4 performs a latch operation at a trailing edge of the clock signal XCLK1.

Shift direction control signals LR1 and LR2 for controlling a shift direction are inputted to control terminals of the clocked inverters 6 and 7. When the shift direction control signal LR1 is in a high level and the signal LR2 is in a low level, each output of the register circuits 2 is provided to an input terminal of the register circuit 2 of the preceding stage. On the other hand, when the shift direction control signal LR1 is in a low level and the signal LR2 is in a high level, each output of the register circuit 2 is provided to an input terminal of the register circuit 2 of the next stage.

Figure 3:
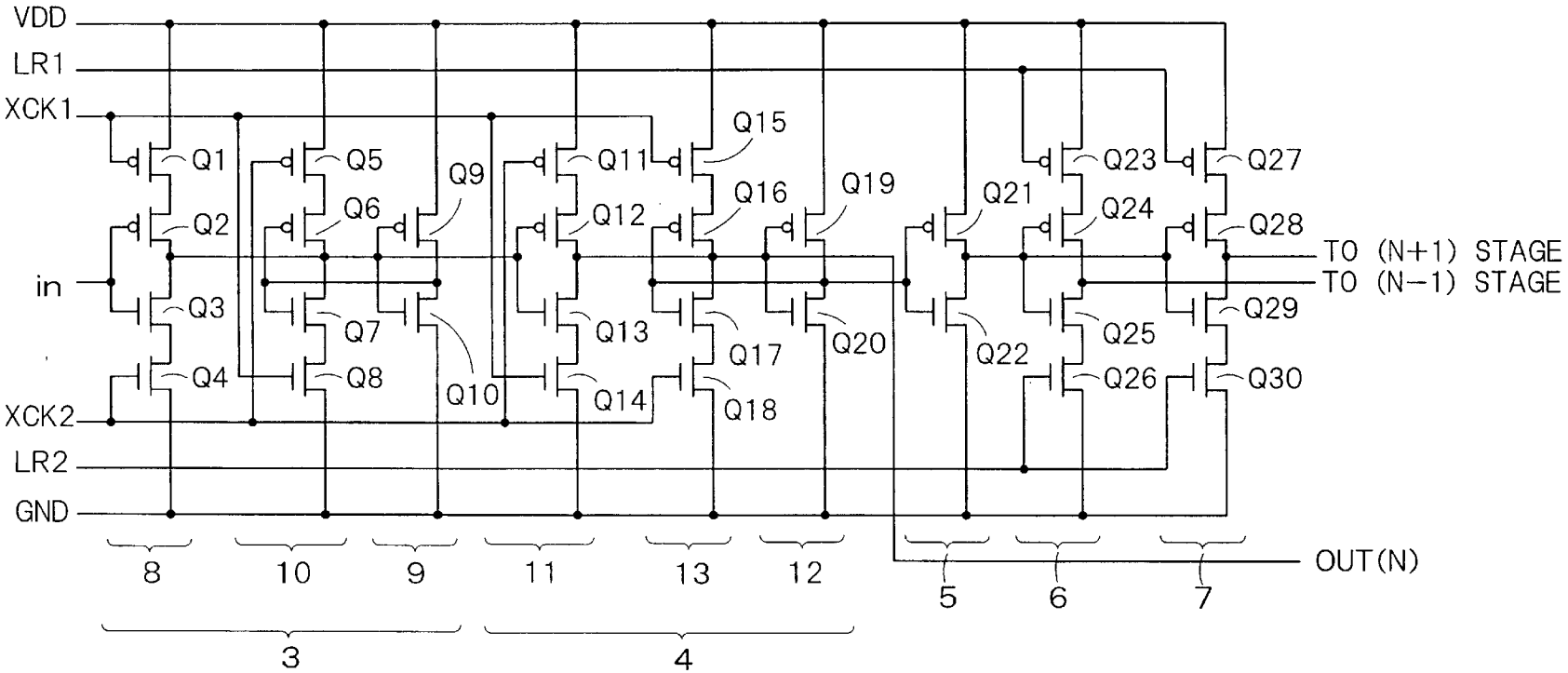
FIG. 3 is a circuit diagram showing a detailed configuration of the shift register of FIG. 2.

FIG. 3 is a circuit diagram showing a detailed configuration of the shift register 1 of FIG. 2. For example, the clocked inverter 8 in the latch circuit 3 of FIG. 2 is composed of transistors Q1–Q4 of FIG. 3. The clocked inverter 10 of FIG. 2 is composed of transistors Q5–Q8 of FIG. 3. The inverter 9 of FIG. 2 is composed of transistors Q9 and Q10 of FIG. 3. The clocked inverter 11 of FIG. 2 is composed of transistors Q11–Q14 of FIG. 3. The clocked inverter 13 of FIG. 2 is composed of transistors Q15–Q18 of FIG. 3. The inverter 12 of FIG. 2 is composed of transistors Q19 and Q20. Furthermore, the inverter 5 of FIG. 2 is composed of transistors Q21 and Q22. The clocked inverter 6 of FIG. 2 is composed of transistors Q23–Q26 of FIG. 3. The clocked inverter 7 of FIG. 2 is composed of transistors Q27–Q30 of FIG. 3.

Figure 4A:
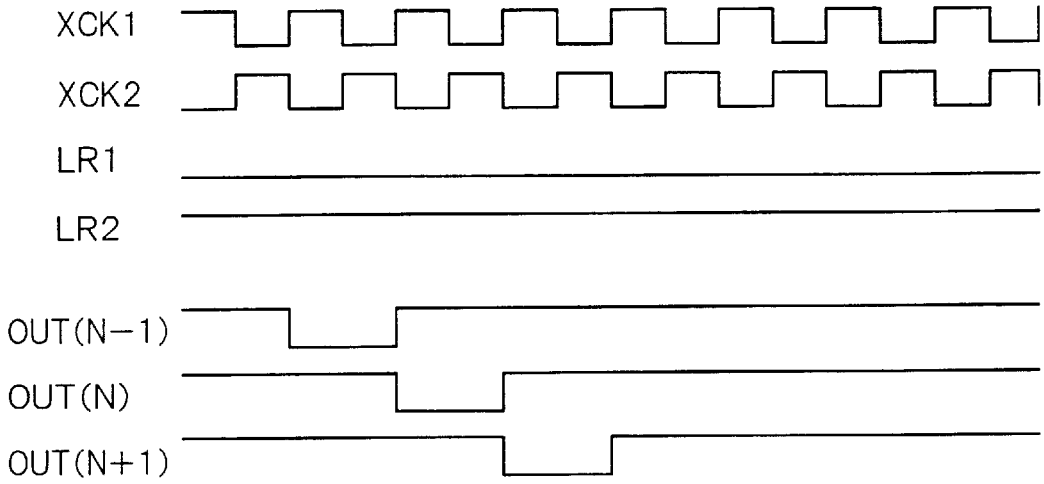
FIG. 4 is an operational timing chart of the shift register of FIG. 2.
Figure 4B:
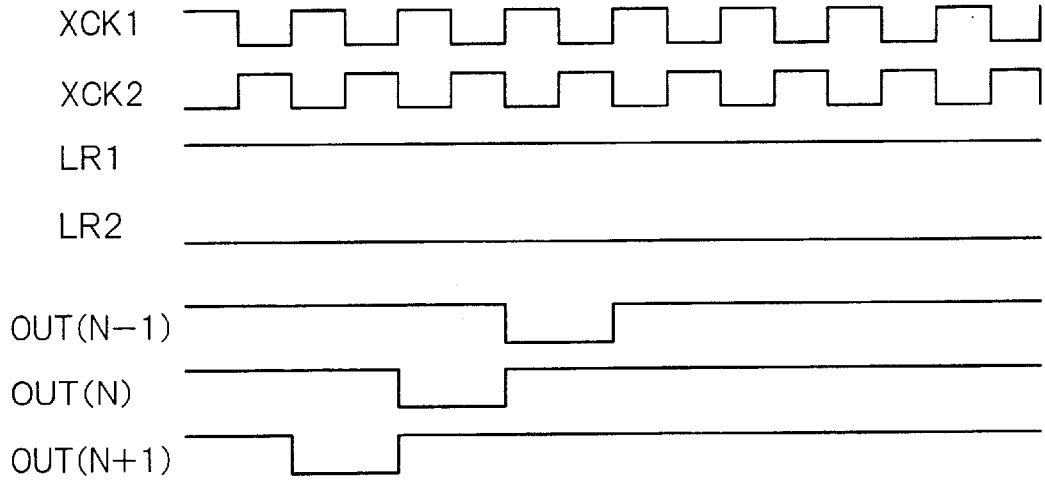

FIG. 4 is an operational timing chart of the shift register 1 of FIG. 2. FIG. 4A shows an example of shifting the shift pulses to a subsequent stage side, and FIG. 4B shows an example of shifting the shift pulses to a preceding stage side. As shown in FIG. 4, it is possible to switch the shift direction by logics of the shift direction control signals LR1 and LR2.

Figure 8:
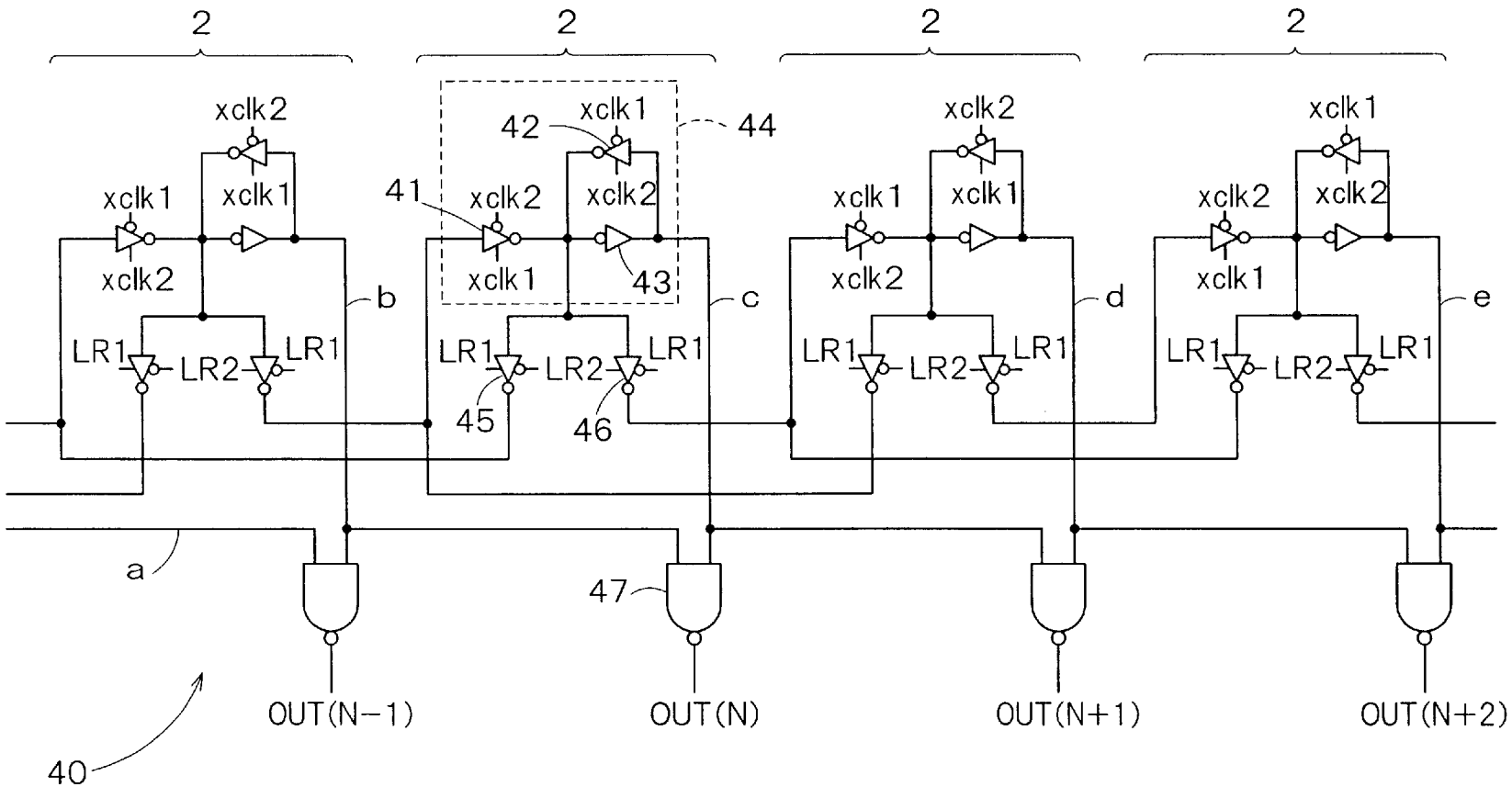
FIG. 8 is a conventional shift register of the half clocl type.
Figure 9A:
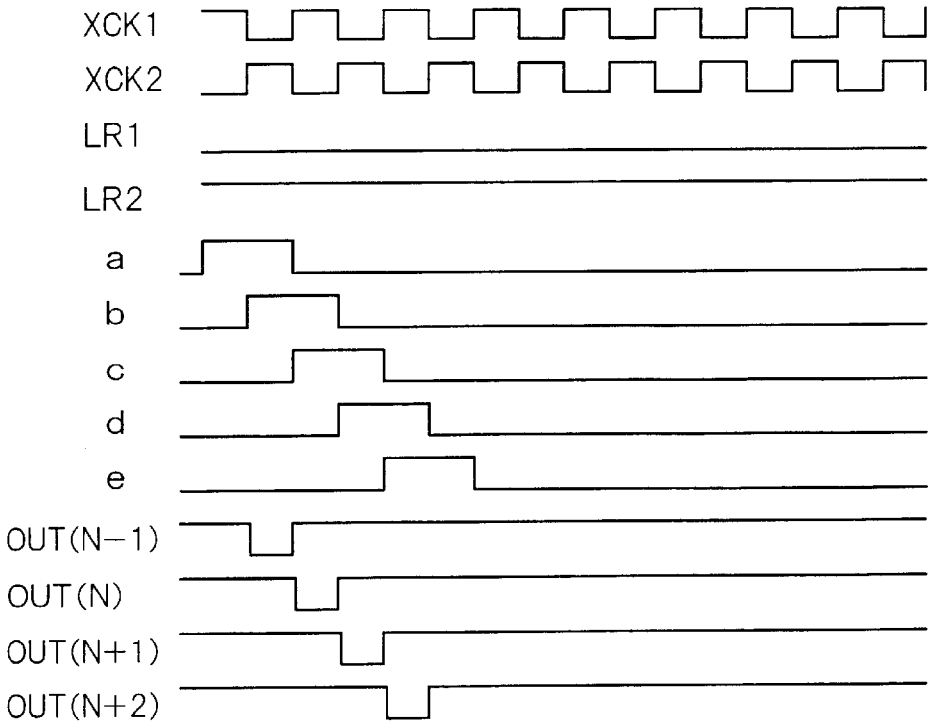
FIG. 9 is an operational timing chart of input/output signals of the shift register of FIG. 8.
Figure 9B:
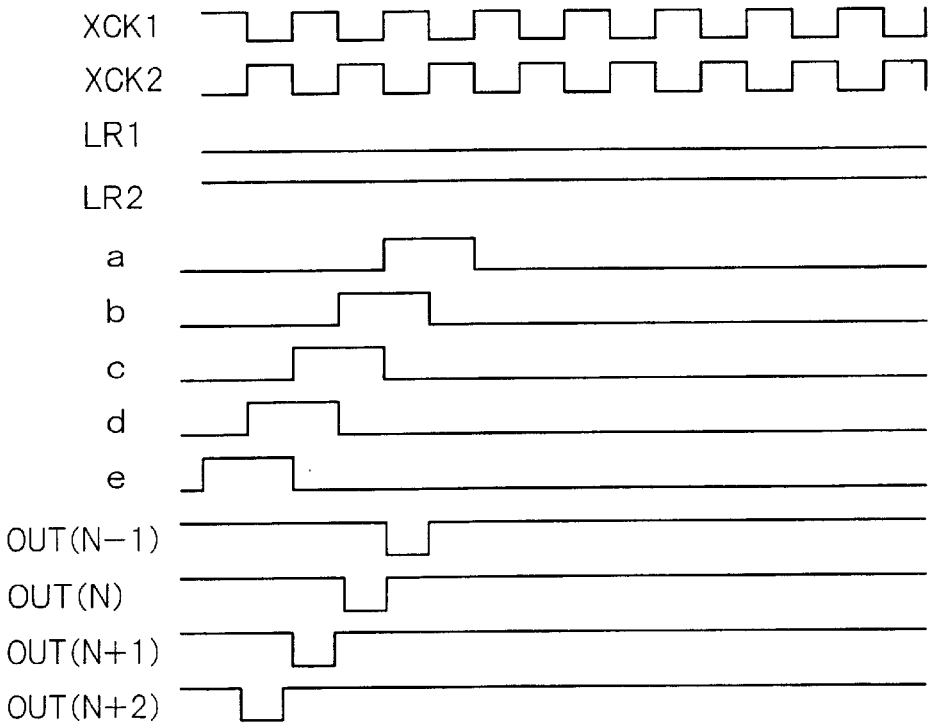
Figure 10:
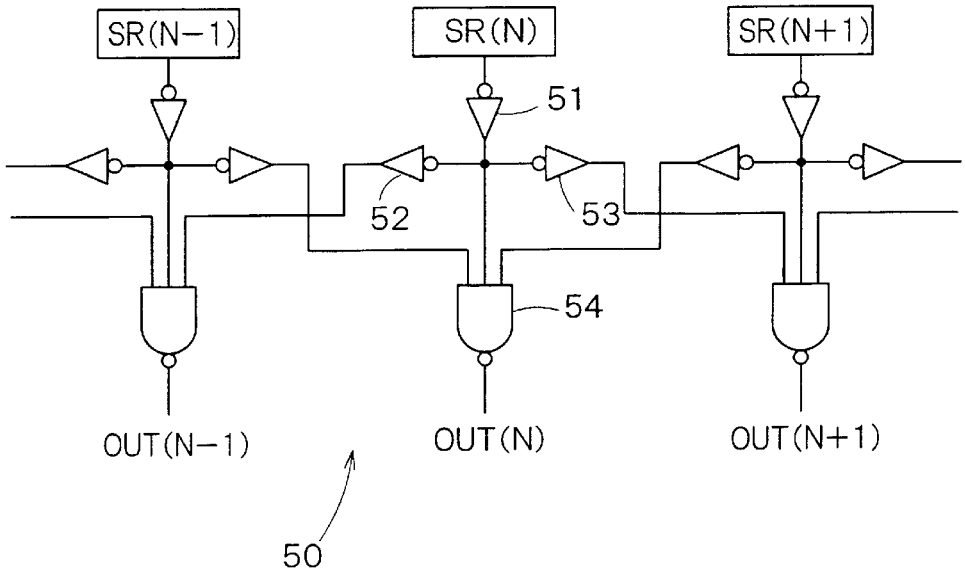
FIG. 10 is a circuit diagram showing an internal configuration of a conventional pulse cut circuit.
Figure 11:
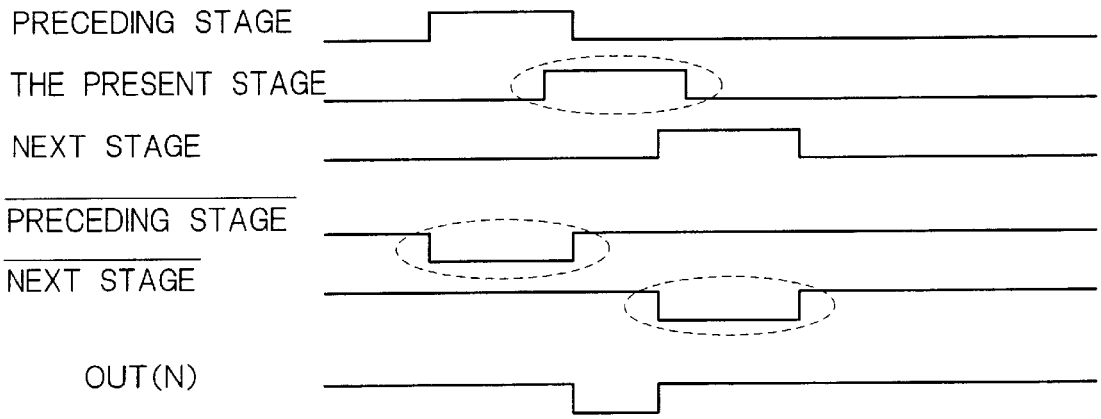
FIG. 11 is an operational timing chart of the circuit of FIG. 10.

In the conventional shift register 1 of the half clock type shown in FIG. 8, although a configuration of the register circuits 2 of the odd stages is different from that of the even stages, the shift registers 1 of FIG. 2 have a common configuration. Accordingly, it is possible to restrain a dispersion of an output timing of the shift pulses of each stage.

In FIG. 2, the output of the register circuit 2 of the preceding stage is inputted to the latch circuit 3 in the register circuit 2 of the present stage. The latch circuit 3 latches the output of the register circuit 2 of the preceding stage at the rising edge of the clock signal XCLK1. The latch output is inputted to the latch circuit 4. The latch circuit 4 latches the output of the latch circuit 3 at the trailing edge of the clock signal XCLK1. The output of the latch circuit 4 is inverted by the inverter 5, and then is outputted as the shift pulse OUT(N).

When the shift direction control signal LR1 is in a high level and the another shift direction control signal LR2 is in a low level, the output of the inverter 5 is fedback to the input side of the latch circuit 3 in the register circuit 2 of the preceding stage via the clocked inverter 6. When the shift direction control signal LR1 is in a low level and the signal LR2 is in a high level, the output of the inverter 5 is transmitted to the input stage side of the latch circuit 3 in the register circuit 2 of the next stage via the clocked inverter 7.

The shift register 1 of FIG. 2 is a so-called bidirectional shift register 1 of the entire clock type, which performs a shift operation by every one cycle of the clock signal XCLK1. The shift register of FIG. 2 minimizes the number of gate stages existing after the start signal is inputted to the shift register 1 and before the control signal is inputted to the gate terminal of the TFTs in the analog switches 63 shown in FIG. 1. Therefore, it is possible to decrease a delay of the clock signal, and the liquid crystal display is not influenced by a dispersion of TFT properties, thereby enlarging an operational margin, as compared with the conventional liquid crystal display.

Furthermore, because the shift register of the half clock type shown in FIG. 8 outputs the shift pulses at both edges of the clock signal XCLK1, there is a likelihood that the display is influenced by a dispersion of a duty ratio of the clock signal XCLK1. However, according to the present embodiment, there is not a likelihood that the display is influenced by a duty ratio of the clock signal XCLK1, thereby outputting the shift pulses at an accurate timing.

Figure 5:
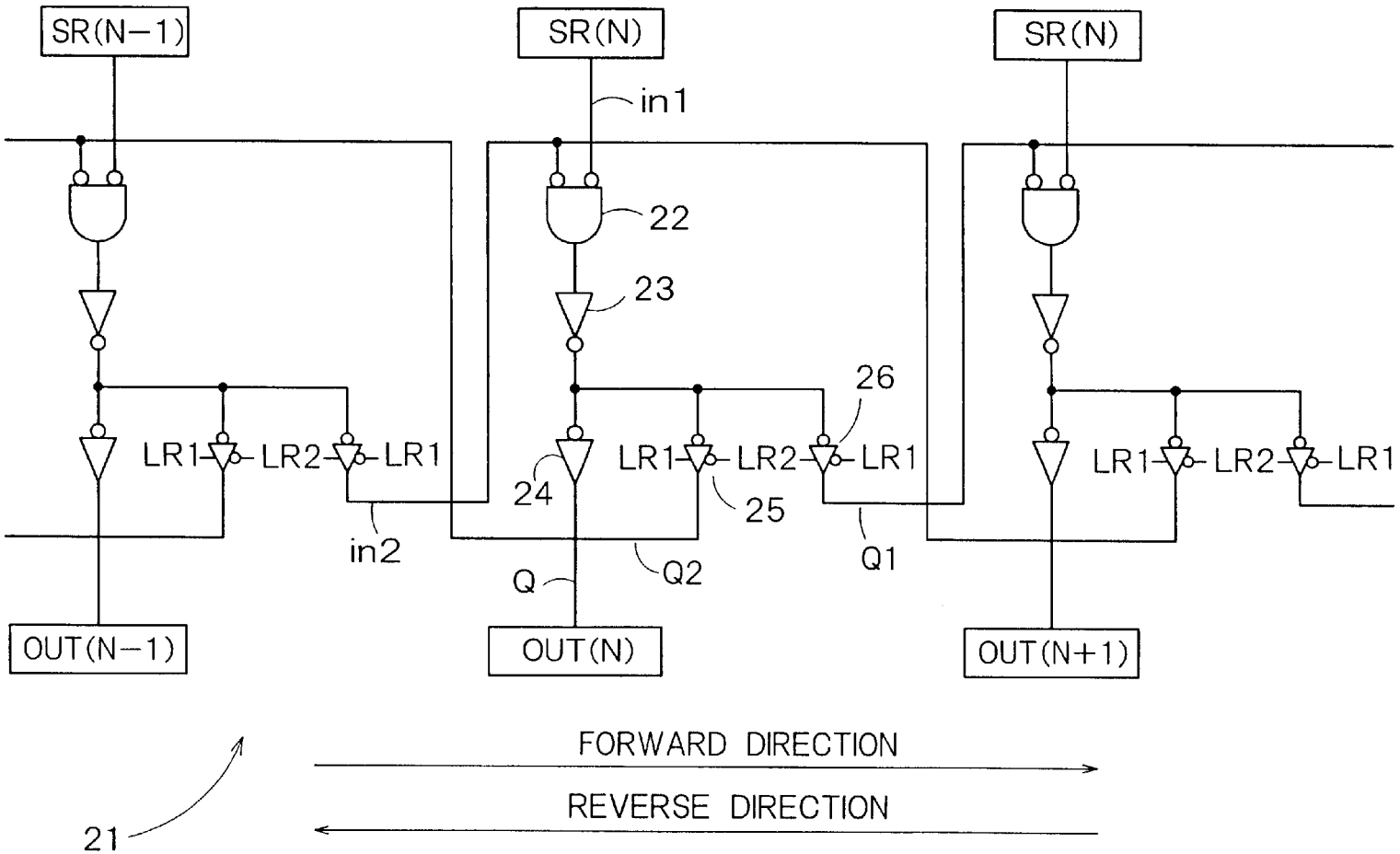
FIG. 5 is a circuit diagram showing an internal configuration of a pulse cut circuit (pulse width adjusting circuit) arranged at a subsequent stage of the shift register of FIG. 2.

FIG. 5 is a circuit diagram showing an internal configuration of a pulse cut circuit (pulse width adjusting circuit) 21 arranged at a subsequent stage of the shift register 1 of FIG. 2. The pulse cut circuit 21 of FIG. 5 has an AND gate 21 of a negative logic, inverters 23 and 24 connected in series to an output stage of the AND gate 22, and clocked inverters 25 and 26 connected to the output terminal of the inverter 23. The output of the inverter 24 is inputted to a control terminal of the analog switch 63.

Figure 6:
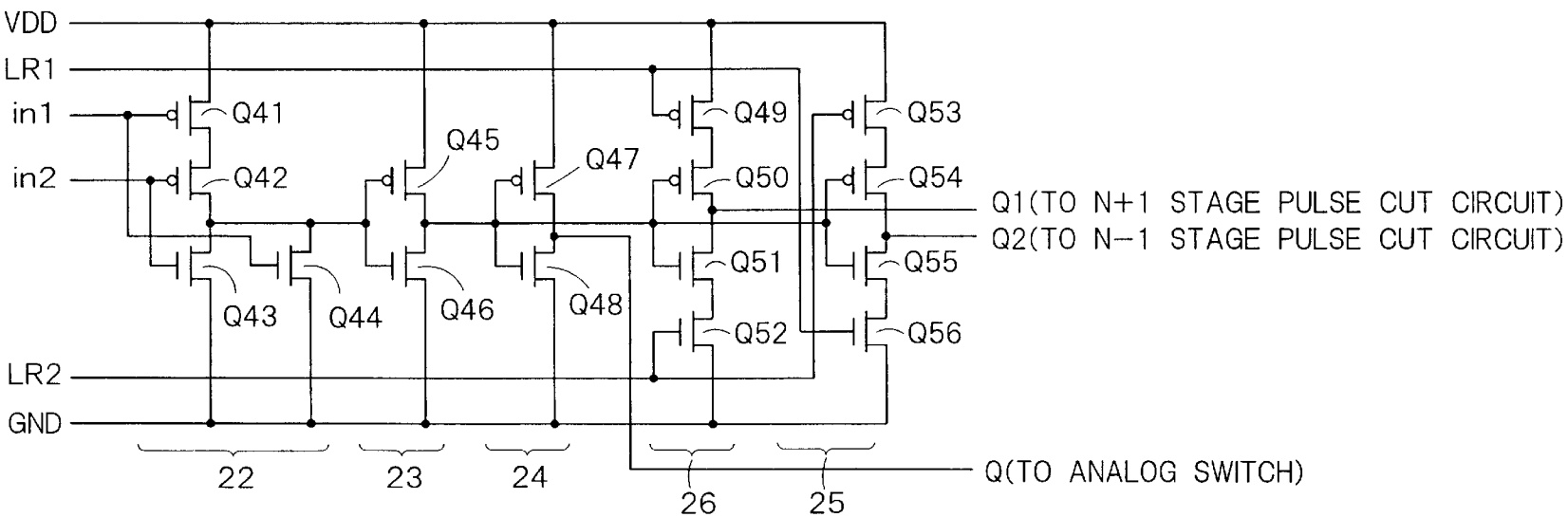
FIG. 6 is a circuit diagram showing a detailed configuration of the pulse cut circuit of FIG. 5.

FIG. 6 is a circuit diagram showing a detailed configuration of the pulse cut circuit 21 of FIG. 5. As shown in FIG. 6, the AND gate 22 of FIG. 5 is composed of transistors Q41–Q44 of FIG. 6. The inverter 23 of FIG. 5 is composed of transistors Q45 and Q46. The inverter 24 of FIG. 5 is composed of transistors Q47 and Q48. The clocked inverter 26 of FIG. 5 is composed of transistors Q49–Q52. The clocked inverter 25 of FIG. 5 is composed of transistors Q53–Q56.

Figure 7A:
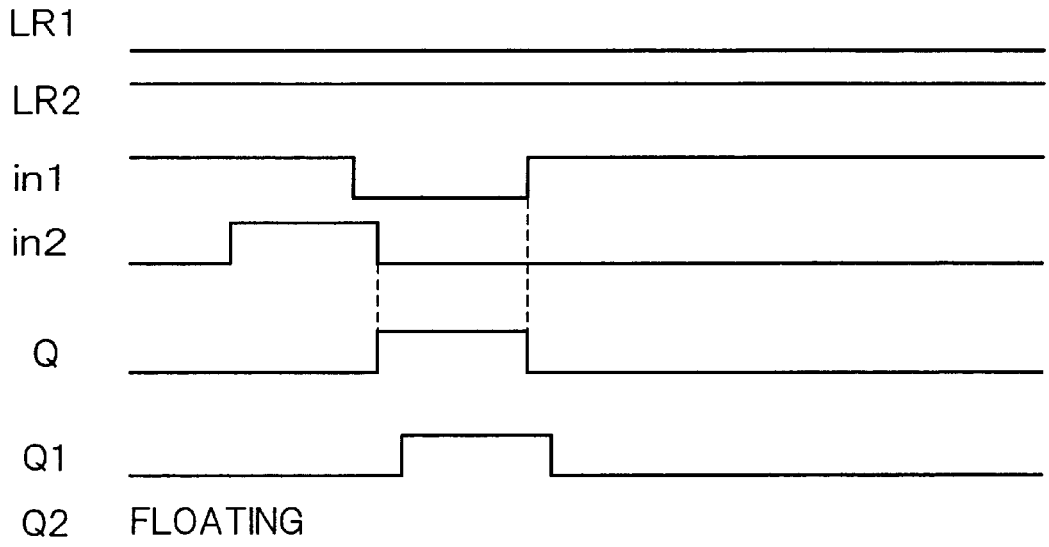
FIG. 7 is an operational timing chart of the pulse cut circuit of FIG. 5.
Figure 7B:
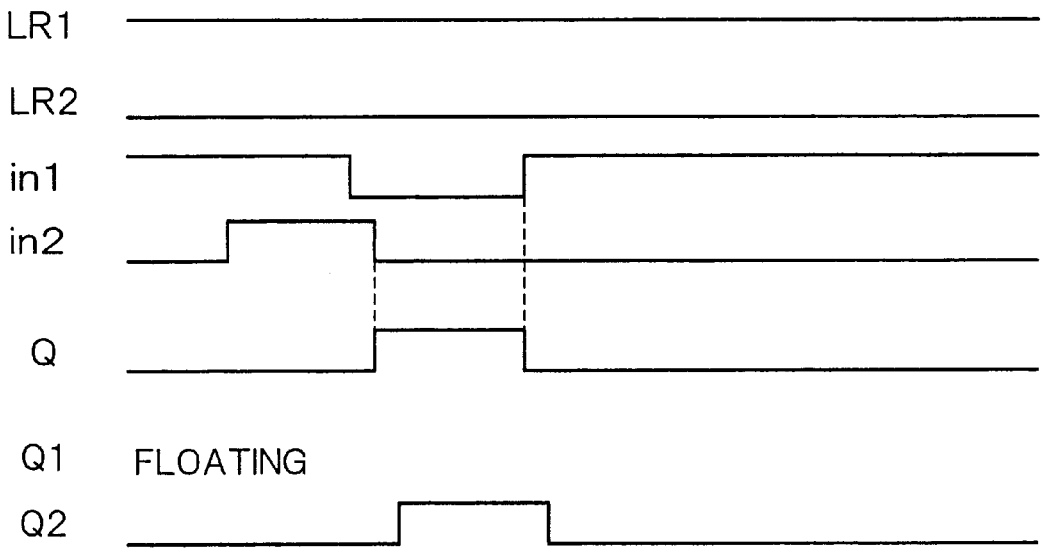

FIG. 7 is an operational timing chart of the pulse cut circuit 21 of FIG. 5. FIG. 7A is an operational timing chart in the case of shifting the shift pulses to the subsequent stage side, and FIG. 7B is an operational timing chart in the case of shifting the shift pulse to the forward stage side.

In FIG. 7, the output of the register circuit 2 of the present stage is expressed as "in1", the output of the clocked inverter 26 of the preceding stage is expressed as "in2", the output of the inverter 24 of the present stage is expressed as "Q", the output of the clocked inverter 26 of the present stage is expressed as "Q1", and the output of the clocked inverter 25 of the present stage is expressed as "Q2".

The AND gate 22 of FIG. 5 calculates a logical multiplication between the output of the clocked inverter 26 of the preceding stage and the shift pulse of the present stage. Therefore, as shown in FIG. 7, head sides of the shift pulses of the present stage, that is, a timing that the analog switch 63 changes from OFF to ON is delayed by the output in2 of the clocked inverter 26 of the preceding stage. Therefore, a pulse signal having narrower pulse width than the shift pulse of the present stage is outputted from the inverter.

When the shift direction control signal LR1 is in a low level and the another shift direction control signal LR2 is in a high level, the output of the inverter 23 is inputted to the AND gate 22 of the next stage. On the other hand, when the shift direction control signal LR1 is in a high level and the another shift direction control signal LR2 is in a low level, the output of the inverter 23 is inputted to the AND gate 22 of the preceding stage.

Thus, because the pulse cut circuit 21 of FIG. 6 shortens an ON time of the analog switches 63 by staggering a timing at which the analog switches 63 turn from ON to OFF, there is not a likelihood that the adjacent analog switches 63 turn ON at the same time, thereby enlarging a timing margin of the clock signal and the video signal, as compared with the conventional liquid crystal display.

In the above-mentioned embodiment, although an example in which the present invention is applied to the shift register 1 in the signal line driving circuit 62 has been explained, the present invention is applicable to the shift register even in the scanning line driving circuit 64.

What is claimed is:

1. A display device, comprising:

signal lines and scanning lines in a matrix form;

display elements arranged in the vicinity of intersections of the signal lines and the scanning lines;

a signal line driving circuit configured to drive each of the signal lines; and a scanning line driving circuit configured to drive each of the scanning lines;

wherein said signal line driving circuit includes:

a shift resister of entire clock-type, having a plurality of resister circuits connected in cascade, capable of allowing a clock signal to shift in two-way directions between these resister circuits, configured to output from each of the resister circuits, shift pulses obtained by allowing the clock signal to shift;

a pulse width adjusting circuit configured to adjust pulse widths of said shift pulses; and a switching circuit configured to turn ON/OFF based on a switching control signal serving as the output of said pulse width adjusting circuit, and to provide a pixel voltage to the corresponding signal line to the ON period, wherein said plurality of resister circuits are composed of the same circuit configuration, respectively; and said pulse width adjusting circuit adjusts the pulse width of said shift pulse so that more than one of said switching circuits do not turn on at the same time, generates a switching control signal of one's own switching circuit based on one's own shift pulse and the switching control signal of the switching circuit at the preceding stage when a shift direction control signal for controlling shift directions of said shift register is in a first logic, and generates the switching control signal of one's own switching circuit based on one's own shift pulse and the switching control signal of said switching circuit at the next stage when said shift direction control signal is in a second logic.

2. The display device according to claim 1, wherein the pixel voltage is provided to the corresponding signal line when said switching circuit is in ON; and said pulse width adjusting circuit adjusts the pulse widths of said shift pulses by staggering a timing in which said switching circuit turns from OFF to ON.

3. The display device according to claim 1, wherein each of said resister circuit includes:

first and second latch circuits connected in cascade;

a first clock inverter configured to provide the output of said second latch circuit to said first latch circuit at the next stage when the shift direction control signal is in the first logic; and a second clock inverter configured to provide the output of said second latch circuit to said first latch circuit at the preceding stage when the shift direction control signal is in the second logic.

4. The display device according to claim 3, wherein said first and second latch circuits include:

a third clocked-inverter configured to latch an input signal by one edge of said clock signal; and inverters connected in ring form and a four clocked-inverter configured to latch an output signal of said third clocked-inverter at the other edge of said clock signal.

5. The display device according to claim 1, wherein said shift resister outputs said shift pulse shifted in units of one cycle of said clock signal.

6. A display device, comprising:

signal lines and scanning lines in a matrix form;

display elements arranged in the vicinity of intersections of the signal lines and the scanning lines;

a signal line driving circuit configured to drive each of the signal lines; and a scanning line driving circuit configured to drive each of the scanning lines;

wherein said scanning line driving circuit includes:

a shift resister of entire clock-type, having a plurality of resister circuits connected in cascade, capable of allowing a clock signal to shift in two-way directions between these resister circuits, configured to output from each of the resister circuits, shift pulses obtained by allowing the clock signal to shift; and a pulse width adjusting circuit configured to adjust pulse widths of said shift pulse, wherein said plurality of resister circuits are composed of the same circuit configuration, respectively; and said pulse width adjusting circuit adjusts the pulse width of said shift pulse so that a plurality of shift pulses do not turn on at the same time, adjusts the shift pulse based on one's own shift pulse and the shift pulse at the preceding stage when a shift direction control signal for controlling shift directions of said shift register is in a first logic, and adjusts the shift pulse based on one's own shift pulse and the shift pulse at the next stage when said shift direction control signal is in a second logic.

7. The display device according to claim 6, wherein each of said resistor circuit includes:

first and second latch circuits connected in cascade;

a first clocked-inverter configured to provide the output of said second latch circuit to said first latch circuit at the next stage when said shift direction control signal is in the first logic; and a second clocked-inverter configured to provide the output of said second latch circuit to said first latch circuit at the preceding stage when said shift direction control signal is in the second logic.

8. The display device according to claim 6, wherein said first and second latch circuits include:

a third clocked-inverter configured to latch the input signal by one edge of said clock signal; and inverters connected in a ring form and a fourth clocked-inverter, configured to latch the output signal of said third clocked-inverter at the other edge of said clock signal.

9. The display device according to claim 6, wherein said shift resister outputs said shift pulse shifted in units of one cycle of said clock signal.

* * * * *